US005975134A

United States Patent [19]

Schwelm

[11] Patent Number: 5,975,134

[45] Date of Patent: Nov. 2, 1999

[54] VALVE SYSTEM

[76] Inventor: Hans Schwelm, Broicherdorfstr. 101, Kaarst D-41564, Germany

[21] Appl. No.: 09/051,074

[22] PCT Filed: Oct. 3, 1996

[86] PCT No.: PCT/DE96/01909

§ 371 Date: Apr. 1, 1998

§ 102(e) Date: Apr. 1, 1998

[87] PCT Pub. No.: WO97/13980

PCT Pub. Date: Apr. 17, 1997

[30] Foreign Application Priority Data

Oct. 9, 1995 [DE] Germany ..... 195 37 482

[51] Int. Cl.[6] ..... F15B 13/043

[52] U.S. Cl. ..... 137/596.15; 137/596.16; 137/884

[58] Field of Search ..... 137/596.15, 596.16, 137/884

[56] References Cited

U.S. PATENT DOCUMENTS

| | | | |
|---|---|---|---|
| 2,911,005 | 11/1959 | Adelson | 137/596.15 |
| 3,838,710 | 10/1974 | Reip | 137/596.15 |
| 3,976,098 | 8/1976 | Raymond . | |
| 4,011,887 | 3/1977 | Raymond | 137/880 |
| 4,230,143 | 10/1980 | Dettmann et al. | 137/884 X |
| 4,359,064 | 11/1982 | Kimble | 137/596.16 X |
| 4,516,604 | 5/1985 | Taplin | 137/596.15 |
| 4,711,267 | 12/1987 | Schwelm | 137/596.15 |
| 4,723,576 | 2/1988 | Raymond | 137/596.15 X |
| 5,372,060 | 12/1994 | Maruyama et al. . | |

FOREIGN PATENT DOCUMENTS

| | | |
|---|---|---|
| 0473030 | 3/1992 | European Pat. Off. . |
| 2023322 | 8/1970 | France . |
| 2146333 | 3/1973 | France . |
| 3604410 | 8/1986 | Germany . |
| 4233783 | 4/1993 | Germany . |
| 9412780 | 10/1994 | Germany . |
| 2212220 | 7/1989 | United Kingdom . |

OTHER PUBLICATIONS

Pippenger: "Hydraulic Cartridge Valve Technology" 1990, Amalgam Publishing Comp., pp. 180–187.

*Primary Examiner*—Gerald A. Michalsky
*Attorney, Agent, or Firm*—McDermott, Will & Emery

[57] ABSTRACT

A central block is disclosed for a pilot controlled valve system with seat and piston valves. The central block has a preferably standardized connection interface (12), a pilot valve interface (13) for receiving a pilot valve (32), a pump conduit (P), a tank conduit (T), a first work conduit (A), a second work conduit (B), a first control conduit x and a second control conduit y, as well as four valve reception cavities (34, 36) for receiving each one valve unit ($C_1$, $C_2$, $C_3$, $C_4$). In order to create a central block which may be universally used with any number of hydraulic circuits and whose connections may be easily modified, the central block is composed of a middle block (2) to which are detachably secured two valve blocks (50, 60, 70, 80, 90, 100, 110, 120). The middle block (2) has two valve sides (6, 10) provided each with a valve block interface (22, 24) which receive each one valve block (50, 60, 70, 80, 90, 100, 110, 120). Each valve block (50, 60, 70, 80, 90, 100, 110, 120) has two valve receiving cavities (34, 36) and the control conduits x and y are arranged in such a way that each valve unit ($C_1$, $C_2$, $C_3$, $C_4$) may be driven by a pilot valve (32) mounted at the pilot valve interface (13).

15 Claims, 8 Drawing Sheets

VALVE SYSTEM

The present invention relates to a central block of a pilot controlled valve system with seat and/or piston valves having a preferably standardised connection interface as well as a pilot valve interface for receiving a pilot valve and being equipped with a pump conduit (P), a tank conduit (T), a first work conduit (A), a second work conduit (B), a first control conduit x and a second control conduit y. Four valve reception cavities for receiving one valve unit (C1, C2, C3, C4) each are provided in the central block.

Valve systems having pilot controlled seat and/or piston valves and having such a central block are known for example from DE-OS 36 04 410, GB 2,212,220 A or from EP 0 473 030 A1.

The DE-OS 36 04 410 discloses a hydraulic control block with a pilot valve, a four port control valve being pilot controlled by the pilot valve, a pressure reducer, a one-way valve and a one-way restrictor. Each of the afore-mentioned elements is hereby located in a separate housing made of cast iron and is connected with the other housing blocks only by means of separate, corresponding hydraulic conduits.

The GB 2,212,220 or EP 0 473 030 A1 disclose a proportional four port control valve with pilot controlled seat valves being located in a housing block cast in iron especially to this purpose, just as the four port control valve disclosed in the DE-OS 36 04 410. This housing block receiving the valve units and referred to in the following as central block is interspersed with hydraulic conduits which assure a hydraulic connection between the four valve units located in the central block.

Production optimized seat valves or combined piston-seat valves are used as valve units and are inserted into corresponding valve reception cavities provided in the central block. These valves are then fastened by means of a lid screwed in the central block. According to the operative range, further components, such as for example a one-way valve, an electromagnetic proportional control unit or the like, and/or more valves, can be installed onto these valves. Such valve units are called cartridges (Cartridge-technique).

The lower side of the control block (DE 36 04 410), or the lower side of the central block (EP 0 473 030) is designed as a connecting interface and has a standard bore scheme according to DIN 24340 so that the control block or the central block can be connected to nearly any new and existing hydraulic system.

The valves located in the central block can be connected in different ways. Therefore, the valves are connected, according to the principles of logic, by means of "and", "or" or "nand" connections. By choosing appropriate valve units (Cartridges) and by combining adequately the valve units, hydraulic circuits can be realized for nearly any application.

Each application requires another connection of the valves, so that for each application an individual central block with the specific hydraulic connections for the respective hydraulic circuit has to be cast. This entails high production costs. As the connection conduits can run slantwise, diagonally or with angles, they have to be incorporated during the cast in the form of a core, rendering thus the manufacturing of such a central block even more expensive.

Since each application requires the manufacturing of its own central block, to store and to keep spare central blocks available becomes very expensive.

When using these valve systems in plastic die casting machines or in industrial robots for example, it may happen that after some time another application required, so that a modified hydraulic circuit has to be used in the plastic die casting machine or in the industrial robot. In this case, the whole central block has to be exchanged and replaced by a new one, so that very high material and mounting costs result from such a procedure.

Starting from these premises, the object of the present invention is to provide a central block for a pilot controlled valve system with seat and/or piston valves which can be used universally for as many hydraulic circuits as required and whose hydraulic circuit can easily be modified.

A technical solution of this object is to develop a central block for a pilot controlled valve system with seat and/or piston valves as mentioned above in such a way that the central block is composed of a middle block to which are detachably secured two valve blocks. The middle block has two valve sides provided each with a valve block interface for the reception of one valve block each, whereas each valve block has two valve reception cavities and the control conduits x and y are arranged in such a way that each valve unit may be driven by a pilot valve mountable onto the pilot valve interface.

A central block designed according to this technique has the advantage that one middle block only has to be manufactured onto which the adequate valve block for each special application case can be mounted together with its valve units (Cartridges). Such valve units are designed as production optimized screwable valves (Cartridge-technique), which allow an easy and fast mounting. Further components, as for example a one-way valve, an electromagnetic proportional control unit or the like, and/or further valves can be mounted onto these valves.

It is also possible to dismount the pilot valve into one or several control components which are mounted onto the respective valve and which pilot control it directly. In this case, the control components replace the pilot valve and the control conduits are no more arranged in the central block, but rather led externally from the control component directly to the valve.

With the present invention it is possible to create with one unique middle block, preferably eight different valve blocks and appropriate cartridges, a system which permits to realize nearly all known three, four or five port control valves of the art. This is made possible by combining the middle block with the appropriate valve blocks in order to create a central block having each time the desired hydraulic circuit. This hydraulic circuit is subject to regularities similar to those known for an electronic circuit.

Thus it is no more necessary to produce a proper casting tool for each central block, the unique casting tool needed for the manufacturing of the middle block is enough for all applications.

A central block designed according to this technical teaching has the advantage that nearly any hydraulic circuit can be realized with only one middle block and only a few valve blocks. The production and storing costs of the central block system according to the invention are hence much lower since the universally usable middle blocks and valve blocks can be produced in bigger quantities and since the small scale production required up to now for the specific hydraulic circuit is no more necessary.

Another advantage of the device according to the invention is that the central block of the invention which is composed of two valve blocks and one middle block can be designed smaller than the central blocks of the art. The central block thus becomes lighter and cheaper, since it requires less material. Moreover, the smaller and lighter central block is more easy to mount.

Still another advantage of the device according to the invention is that the valve blocks can be screwed onto the middle block together with the valve unit(s) (Cartridges) desired in that specific case. In case the demands upon the hydraulic circuit are modified, a new hydraulic circuit can be provided by exchanging one or the two valve blocks, no new central block having to be casted or mounted therefore. This clearly reduces the costs.

In a preferred embodiment, the valve units $C_1$, $C_2$, $C_3$, $C_4$ are connected via the hydraulic conduits in such a way that by inverting the direction of the flow in the hydraulic conduits, the flow direction in the valve units $C_1$, $C_2$, $C_3$, $C_4$ is also inverted. A universal construction of the middle block and of the valve blocks is thus achieved, so that one and the same middle block can be used in many different hydraulic applications thanks to the use of intelligent circuits. Thus, one and the same central block can be used in different applications and for different hydraulic circuits without the central block having to be reset. This too is a factor that reduces storing and mounting expenses. It also reduces considerably the moulding time of the machine involved.

In another preferred embodiment, the valve units are diagonally drivable. Thus, two valve units can be linked hydraulically.

In another, preferred development of the central block according to the invention, the middle block is divided into two different sections. In the rear section of the middle block are located the pump conduit (P) and the tank conduit (T), whereas the work conduits (A) and (B) are arranged in a front section of the middle block. This separation in space of the hydraulic conduits facilitates the manufacturing, especially the casting of the middle block, since the casting cores to be used may be less complicated.

In a preferred development, the pump conduit (P), the tank conduit (T) and/or the work conduits (A, B) are arranged partly perpendicular and partly parallel to the connecting side.

The perpendicular or parallel arrangement of the hydraulic conduits has the advantage that the conduits need not, or need not all be cast into the middle block by means of a core. It is now possible to insert the conduits subsequently, for example by drilling.

Another advantage is that if needed, more conduits can be arranged subsequently by drilling new channels.

Thanks to the short distances and the mostly straight arrangement of the conduits it is still another advantage that practically no pressure loss and no hysteresis occur.

In an advantageous development, the middle block used essentially as fluid distributor is designed according to the invention in such a way that it has a connecting side, a left and a right valve side and a pilot valve side. From the connecting side designed as a connection interface, one pump conduit (P) and one tank conduit (T) each are leading to each of the two valve sides designed as valve block interfaces, and the work conduit A leads from the connection interface to the left valve side, while the work conduit B leads to the right valve side.

It is thus possible to connect both valve blocks to the pump conduit (P) and to the tank conduit (T) and that the two left side valve units control the work conduit A whereas the two right side valve units control the work conduit B. By choosing the appropriate valve units and their control system, it is possible to create nearly any hydraulic circuit.

In order to create the hydraulic circuit needed for each particular application, the middle block according to the invention is combined with two valve blocks appropriate for the particular application. Only a few different types of valve blocks are needed in order to realize almost all hydraulic circuits, as will be explained in more details in the description of the figures. Hereby, all valve blocks have an interface compatible with the valve block interface of the middle block.

In a particularly preferred embodiment, the two valve block interfaces of the middle block have identical bore schemes. This has the advantage that the valve blocks can be mounted either onto the left or onto the right valve side, depending on the application. The number of valve blocks needed is thereby reduced and this reduces also the costs involved.

In another, preferred development, the valve block interfaces have point symmetric bore schemes. Thus, the valve blocks can still be mounted onto the same valve side after having been turned by 180° around their center line. This further reduces the number of valve blocks needed.

In another preferred embodiment, fastening devices are provided on the valve block by means of which further valves or other components can be fastened onto the valve block. This is of advantage in case, for example, a one-way valve, a distance sensor and/or a second valve have to be mounted additionally to the seat valve.

A valve block is for example designed as a two port flow governor for an injection system of a plastic die casting machine, whereas the other valve block has a press safety control. It is only by combining the two valve blocks with the middle block that an injection system for a plastic die casting machine is created.

In another preferred embodiment, the connecting conduits leading to the tank conduit (T) and/or to the pump conduit (P) are arranged within the valve block in such a way that they run into the middle block interface outside of the valve plane, whereas the other connecting conduits which lead to the work conduits and the ones connecting the valves are arranged within the valve plane. The connecting conduits are thus arranged, like in the middle block, in two different planes or sections. The work conduits are hereby placed within the valve plane, so that on one hand the distances are short and on the other hand, that little or partly no bends at all are needed. This renders the production of these connecting conduits easy.

According to the present invention another technical solution of the object mentioned above suggests a valve block for a two or three port control valve with seat and/or piston valves, the valve block being provided with exactly one tank conduit and one pump conduit, whereas the tank conduit runs into the first valve reception cavity and the pump conduit runs into the second valve reception cavity.

In a preferred development, the valve reception cavities are connected via connecting conduits either directly or via a work conduit A or B. Hereby, the flow is directed towards the valve s once from the side, once from underneath, so that all possible hydraulic circuits can be realized with only a few valve blocks.

In a preferred development, the connecting conduits are connectable with the desired work conduit via supplementary conduits, whereas these supplementary conduits can be mounted subsequently onto the valve block.

Thanks to the valve blocks according to the invention, it is possible to build any hydraulic circuit with only a few valve blocks which can be manufactured at low cost in big quantities. This can be done by building a two or three port control valve by using one unique valve block with appropriated valve units (Cartridges) or by building a three, four or five port control valve by mounting two valve blocks with corresponding valve units (Cartridges) onto a middle block.

In still another preferred embodiment, so called blind pockets are provided in the middle block and in the valve blocks, i.e. that the hydraulic conduits are closed at one end. Only when it has been settled which conduit (P, T, A, B, x, y) is needed for the particular circuit, the conduit is opened, for example by drilling.

This has the advantage that for example such a middle or valve block can be universally used, since one and the same block can be used for any circuit.

Further advantages of the central block according to the invention will become apparent in the description of the preferred embodiments and of the drawing enclosed. The above mentioned characteristics and the ones mentioned below can be realized one by one or in any combination within the scope of the invention. The embodiments mentioned are not exclusive. They should be understood as examples. The FIGS. 0 through 14 of the drawing show embodiments of the invention and will be explained in detail in the following.

Figure 1:
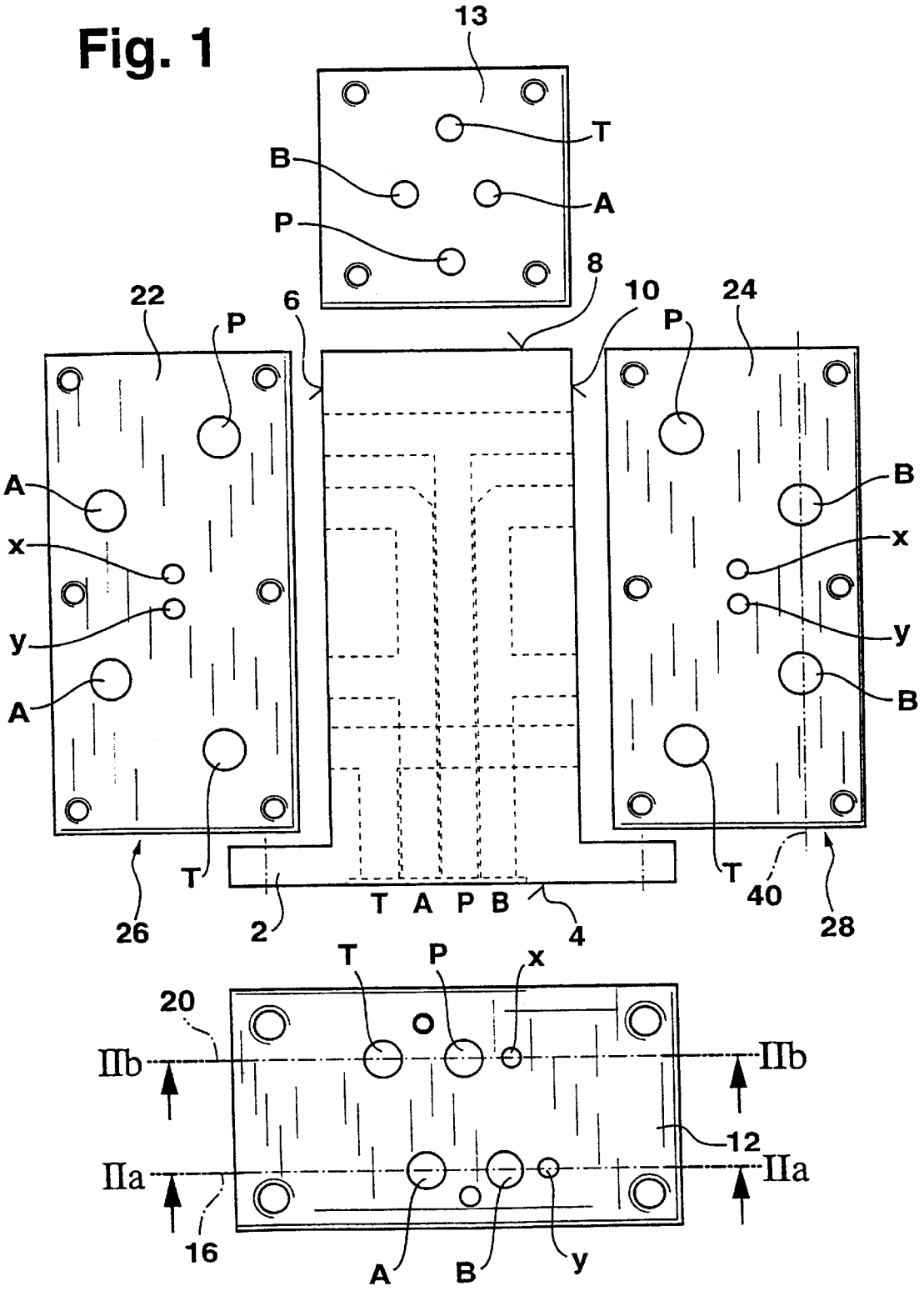
FIG. 1 shows a front view of a middle block according to the invention with its corresponding interfaces.
Figure 2A:
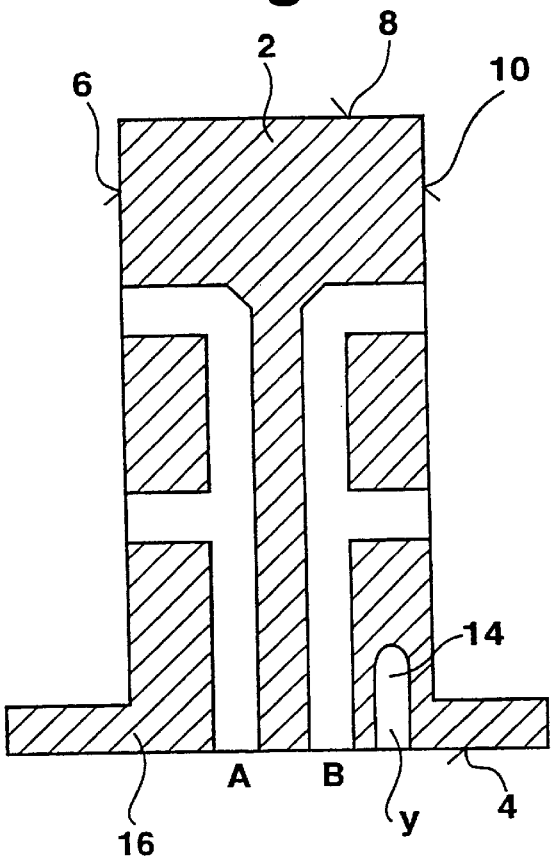
Figure 2B:
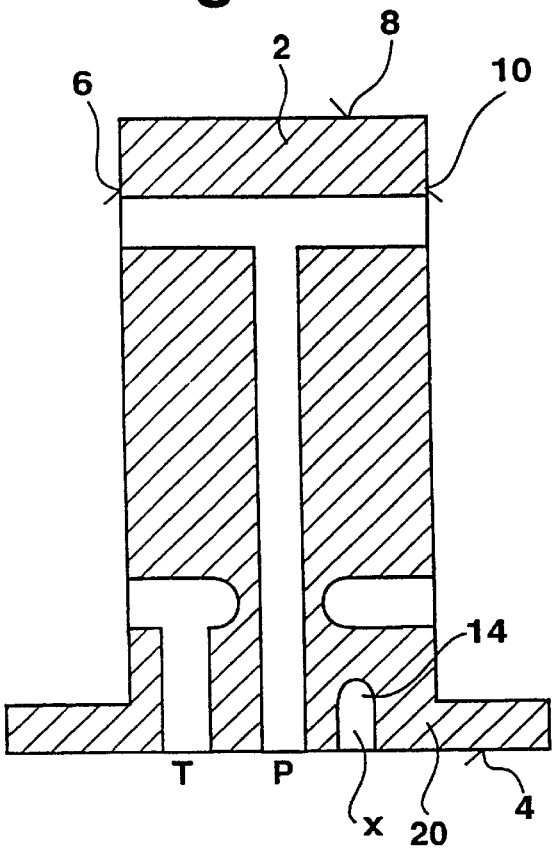
Figure 2C:
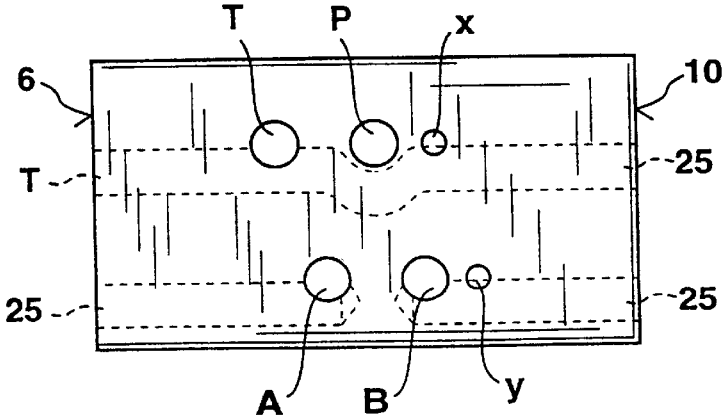
Figure 3:
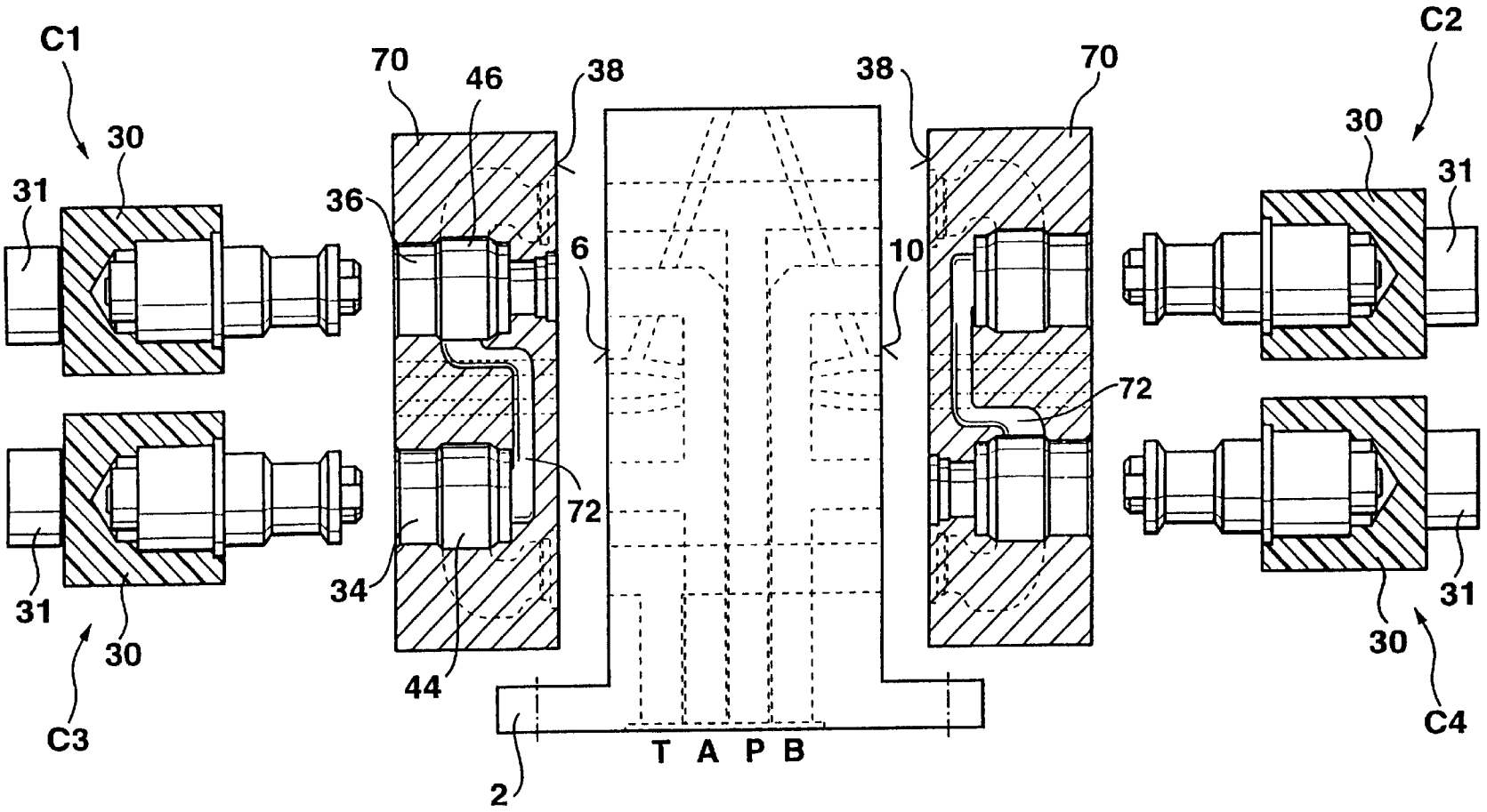
Figure 4:
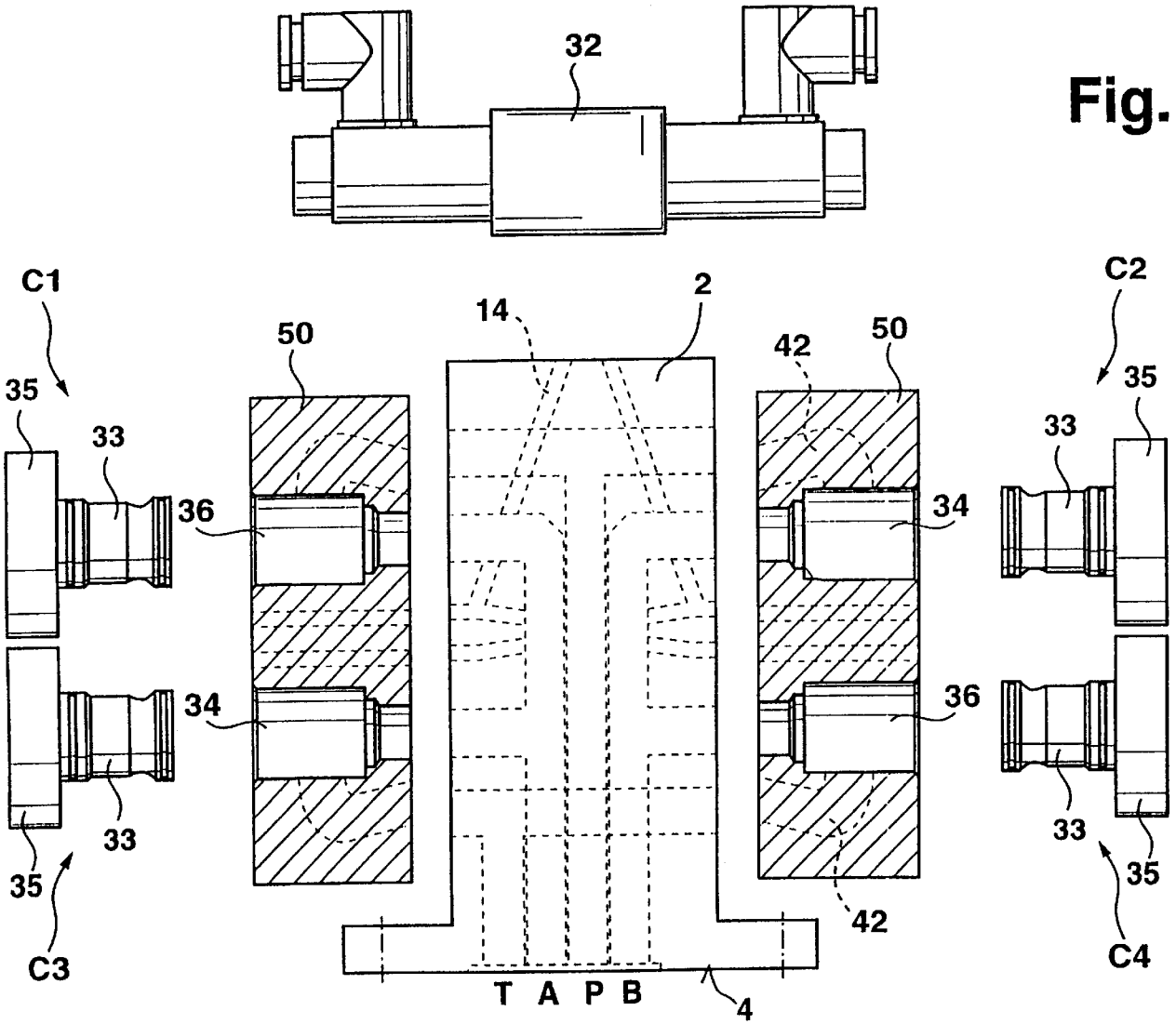
Figure 13:
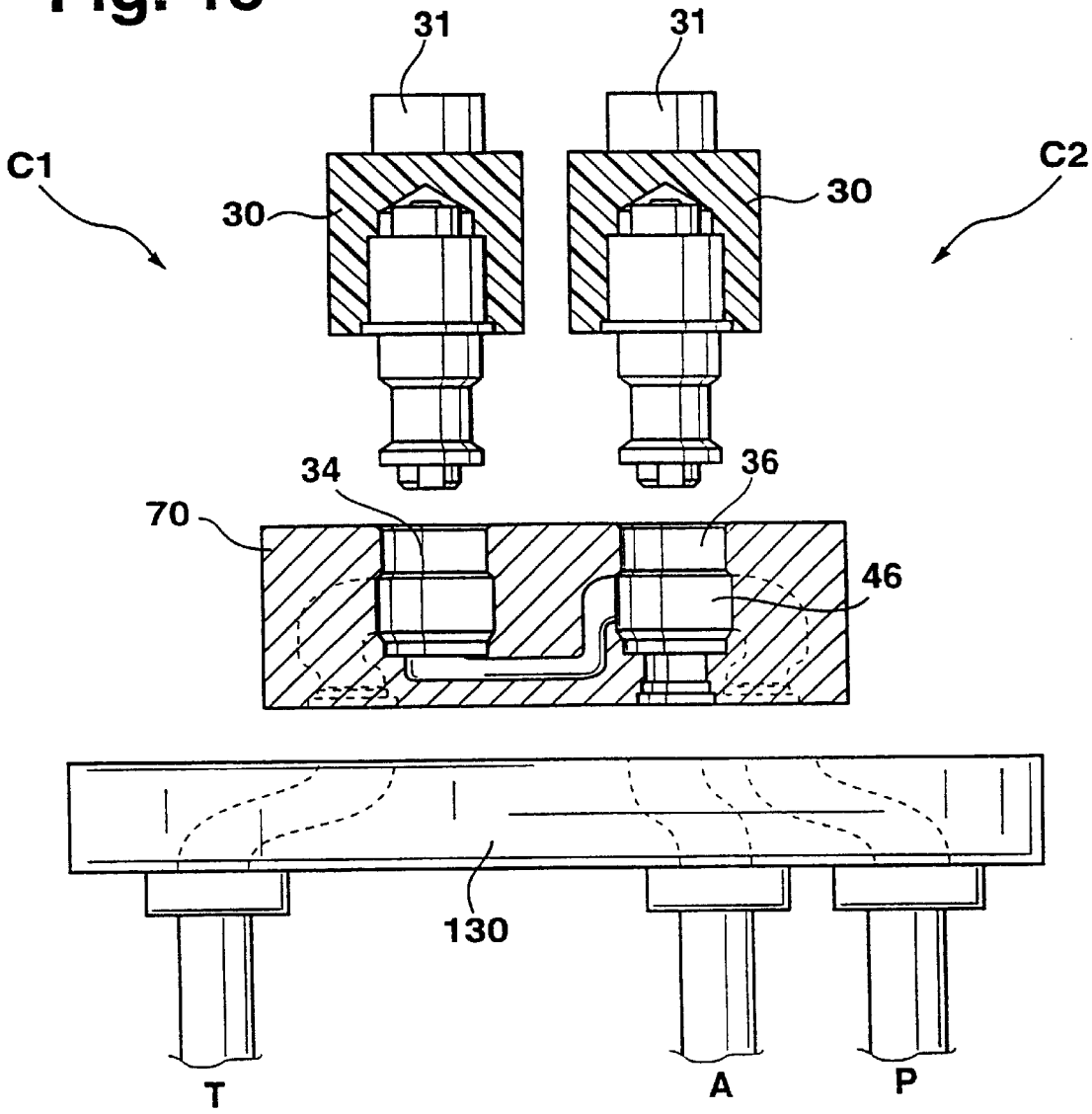
Figure 14:
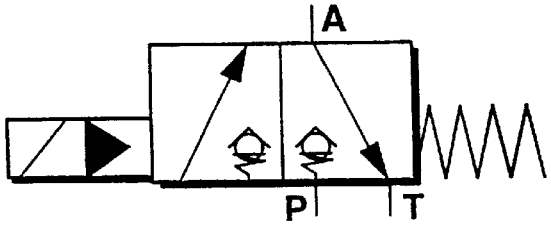

FIG. 2*a* shows a sectional view through the front part of the middle block according to FIG. 1 along the line IIa—IIa in FIG. 1;

FIG. 2*b* shows a sectional view through the rear parts of the middle block according to FIG. 1 along the line IIb—IIb in FIG. 1;

FIG. 2*c* shows a view from underneath of the middle block according to FIG. 1;

FIGS. 3 and 4 show two different embodiments of a hydraulic central block according to the invention;

FIGS. 5 to 12 show different valve blocks, which are compatible with the middle block according to FIG. 1;

FIG. 13 shows a directional control valve with two valve units;

FIG. 14 shows the connecting diagram of the directional control valve according to FIG. 13.

The different figures of the drawing show the subject matter according to the invention partly in a very simplified way and are not to be understood true to scale. The objects of the different figures are partly super proportionally enlarged in order to better show their design.

Figure 0:
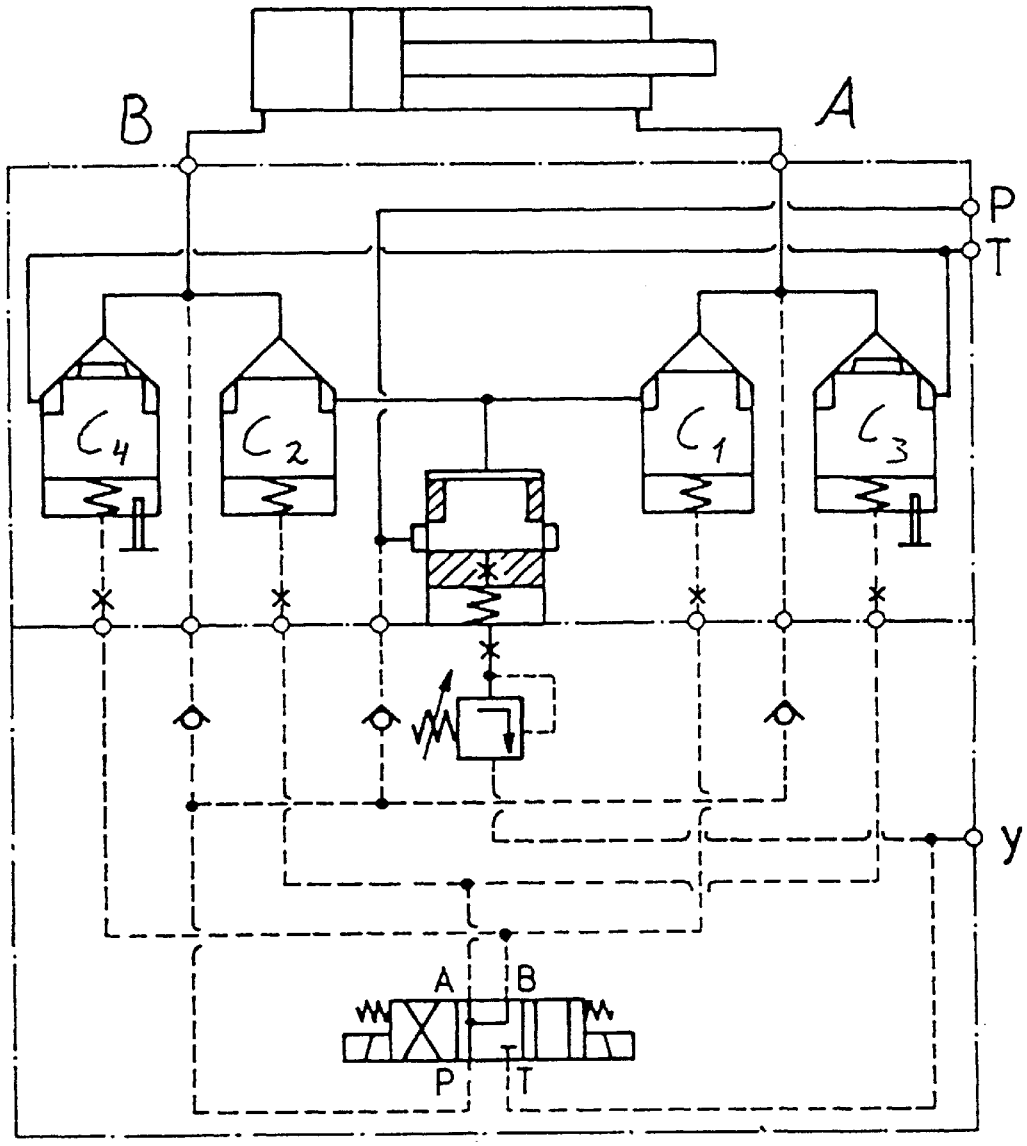
FIG. 0 shows a pictorial schematic view of a known hydraulic circuit.

In FIG. 0, a schematic diagram of a hydraulic control block with a known hydraulic circuit having four valve units $C_1$, $C_2$, $C_3$, $C_4$ is shown. In the design according to the invention, the four valve units $C_1$, $C_2$, $C_3$, $C_4$ are arranged into two valve blocks, which are fastened onto a middle block, as will be described in more detail in the following. The hydraulic conduits shown schematically in this schematic diagram are realized in the middle block and in the valve blocks and provide hydraulic links between the different valves.

In the FIGS. 1 and 2*a* through 2*c*, an embodiment of a middle block 2 according to the invention is shown. The middle block 2 has a connecting side 4, a left valve side 6, a pilot valve side 8 and a right valve side 10. All sides of the middle block 2 are provided with interfaces so that the middle block 2 can be connected with other components. A connecting interface 12 is provided on the connecting side 4 and a pilot valve interface 13 is provided on the pilot valve side 13, both having a standard bore scheme according to DIN 24 340. The middle block which can be seen here is conceived for a hydraulic system of a nominal size of 16 mm and can be connected to corresponding hydraulic systems without any problem thanks to its standardized connecting interface 12.

In other embodiments not shown the middle block 2 is conceived for hydraulic systems of a nominal size of 6 mm, 10 mm, 25 mm, 32 mm or 50 mm and is provided with a connecting interface 12 corresponding to each nominal size respectively according to DIN 24 340.

The pilot valve interface 13 however is the same for all embodiments and corresponds to the bore scheme of DIN 24 340 for nominal size 06.

The middle block 2 is actually used as a fluid distributor since its pump conduit P, its tank conduit T, its two work conduits A and B and the control conduits x and y distribute the fluid coming from or running off the corresponding conduits of the hydraulic system to the corresponding valves. In these embodiments, the middle block 2 has additional control conduits 14, by means of which a pilot valve arranged onto the pilot valve side 8 can control the other valves.

The conduits within the middle block 2 are located in two different sections or planes: a front section 16 and a rear section 20. In the front section 16, the work conduits A and B are running, whereas the work conduit A is connecting the connection interface 12 with a valve block interface 22 of the left valve side 6, the work conduit B connecting the connection interface 12 with the valve block interface 24 of the right valve side 10. The longitudinal axes of each conduit is hereby not running on one plane but slightly spaced. As can be seen from FIG. 2*c*, the dashed horizontal segments 25 of the hydraulic conduit P, T, A and B are running slightly out of line in relation to the vertically running segments P, T, A and B, although they still are located within the same section 16 or 20, respectively.

In the bore schemes 26, 28 of the valve block interfaces 22, 24, two connections A and B, respectively, are provided to the corresponding work conduit A and B, respectively, (see FIG. 2*a*).

The control conduits 14 are running from the connecting side 4 towards the pilot valve side 8 and connect the right and the left valve side 6, 10 with the connecting side 4 and the pilot valve side 8, the control conduits 14 however do not run in one of the sections 16 or 20 but are running irregularly within the middle block 2.

The tank conduit T as well as the pump conduit P are running in the rear section 20 (see FIG. 2*b*). Both conduits are connecting the connecting side 4 with each of the two valve sides 6, 10 and are running partly perpendicular and partly parallel to the connecting side 4 just as it is the case with the work conduits A, B.

Although, the tank conduit T and the pump conduit P are essentially running within the rear section 20, the tank conduit T has to be led around the pump conduit P when it meets the latter, so that it is a little projecting outside the rear section 20 at that point.

The bore schemes 26, 28 of the valve block interface 22, 24 are identical so that a valve block, not shown in FIG. 1, can either be arranged onto the left 6 or onto the right valve side 10.

In FIG. 1, the control conduits 14 are not shown, in order for the picture to remain neat and clear.

In the FIGS. 3 and 4 two examples of embodiments of the valve system according to the invention are shown, in both of which the middle block 2 used as a fluid distributor is the same.

In the first embodiment according to FIG. 3 one valve block 70 is arranged on either valve side, i.e. one on the right valve side 10 and one on the left valve side 6, its valves 30 being designed as seat valves. The valve blocks 70 are hereby connected with a connecting conduit 72 in such a way that the valves are connected in series. The valves 30 are provided with electromagnetic proportional control units 31 so that they can be opened and closed in a controlled way. The valve 30 is available together with the proportional control unit 31 as a prefabricated valve unit (Cartridge). This cartridge only needs to be plugged into the corresponding valve reception cavity 34.

A control block provided with such a directional control valve needs no pilot valve and is mainly used in machinery with suspended loads which have to be very tight. Such machines are for example cranes, presses or motor aerial ladders.

In the embodiment shown in FIG. 4, two valve blocks 50 are arranged onto the middle block 2, whereas the valves 33 of the valve blocks are provided with a parallel connection. In this embodiment, a pilot valve 32 is connected onto the pilot valve side 8 of the middle block 2 which controls via control conduits 14 the different valves 33 arranged on the valve blocks 50. Hydrostatic controlled one-way valves 35 are arranged on the rear sides of the valves 33, so that each valve unit (Cartridge) plugged into a valve reception cavity 34, 36 consists in the valve 33 and the one-way valve 35 and forms in its basic function a 2/2 port directional control valve of a logic element.

A directional control valve according to FIG. 4 is also used in machines with suspended loads, but it is not absolutely tight so that it is mainly used for controlling rotatory actuation (hydrostatic motors) and translational actuation (hydrostatic cylinders) with holding function.

The two embodiments shown in FIG. 3 and in FIG. 4 serve only as examples. It is very much possible to arrange any valves and valve blocks in whatever combinations onto the middle block 2. This is also true for the pilot valve 32. It is also possible to arrange two different valve blocks onto the middle block 2.

In the FIGS. 5 to 12, different valve blocks 50, 60, 70, 80, 90, 100, 110, 120 are shown which are all compatible with the middle block 2. All valve blocks 50, 60, 70, 80, 90, 100, 110, 120 have two valve reception cavities 34, 36 into which a valve can be plugged. This technique is well known as Cartridge-technique. The control conduits x, y are not shown here, in order to keep the picture clear.

Moreover, each valve block 50, 60, 70, 80, 90, 100, 110, 120 has fastening devices which are not shown for the reception of further valves, electromagnetic proportional control units, distance sensore, pilot valves or the like.

The valve reception cavities 34, 36 are arranged parallel to the axis and are located in a valve plane 40 arranged vertically to the middle block interface 38.

The valve blocks 50, 60, 70, 80, 90, 100 have at least one pump connecting conduit 42' and one tank connecting conduit 42 connecting a valve space 44 made of the valve 30, 33 and the valve reception cavity 34, 36 with the tank conduit (T) or with the pump conduit (P). This pump and tank connection conduit 42, 42' is not located in the valve plane 40 but leads from the valve plane 40 to a plane corresponding to the rear section 20. The valve plane 40 hereby corresponds to the front section 16.

The valve blocks 110 and 120 have one pump connecting conduit and one tank connecting conduit 42, 42' each, these conduits connecting the front of the valve with the tank conduit (T) or with the pump conduit (P).

Figure 5:
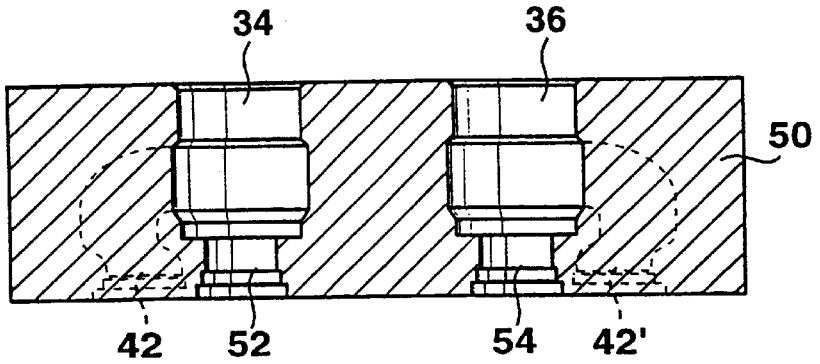

The valve block 50 shown in FIG. 5 has its valve units connected in series, whereas the work conduits 52, 54 leading from the valve reception cavity 34, 36 to the middle block interface 38 are located within the valve plane 40.

Figure 6:
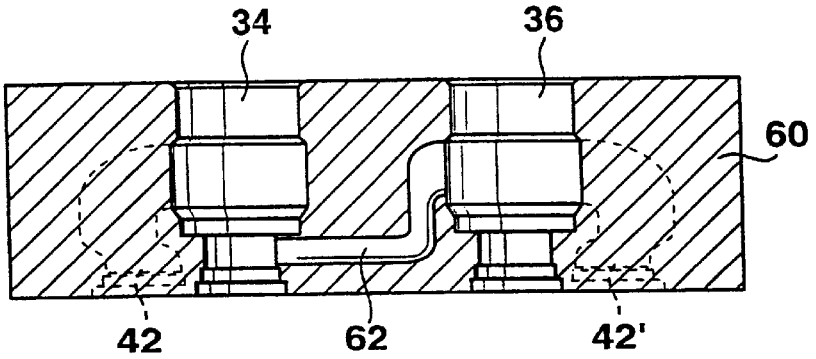

In the valve block 60 shown in FIG. 6, the valve units are connected in parallel. This valve block 60 corresponds to the valve block 50 shown in FIG. 5 but is additionally provided with a connecting conduit 62 leading from the outlet of the valve reception cavity 34 to the valve space 46 of the valve reception cavity 36.

Figure 7:
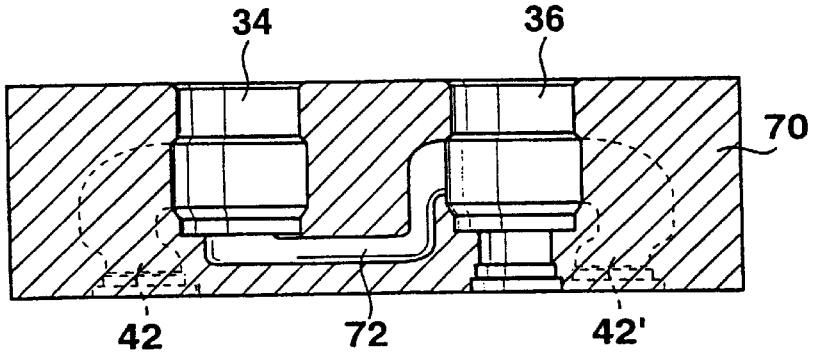

The valve block 70 shown in FIG. 7 corresponds to the valve block 60 shown in FIG. 6 but has no connection from the valve reception cavity 34 to the work conduit A or B, respectively.

Figure 8:
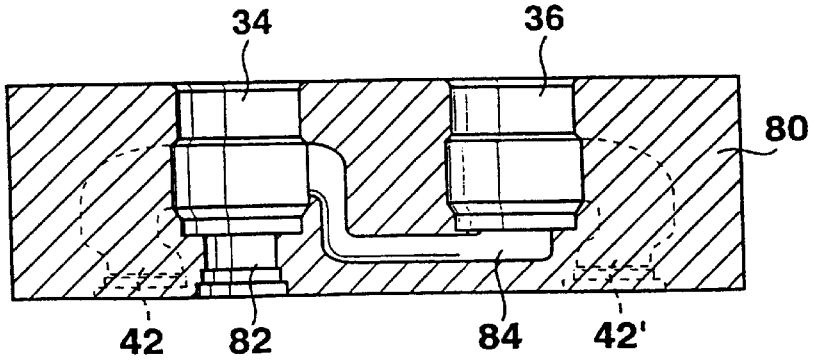

The valve block 80 shown in FIG. 8 corresponds to the valve block 70 shown in FIG. 7, except that the position of the connecting conduits 82 and 84 is symmetrically opposed.

Figure 9:
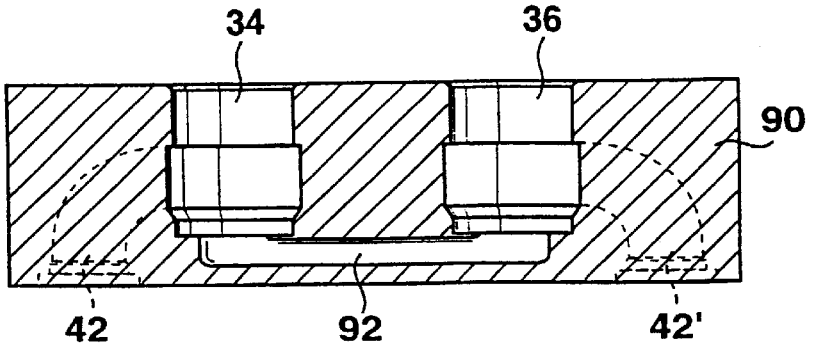

In the valve block 90 shown in FIG. 9, the valve units are connected in series as it is also the case in the valve blocks 70 and 80, but in the valve block 90, the drive in a valve unit is inverted. The outlets of the valve reception cavities 34 and 36 are hereby connected by a work conduit without a connection existing to one of the work conduits A or B.

Figure 10:
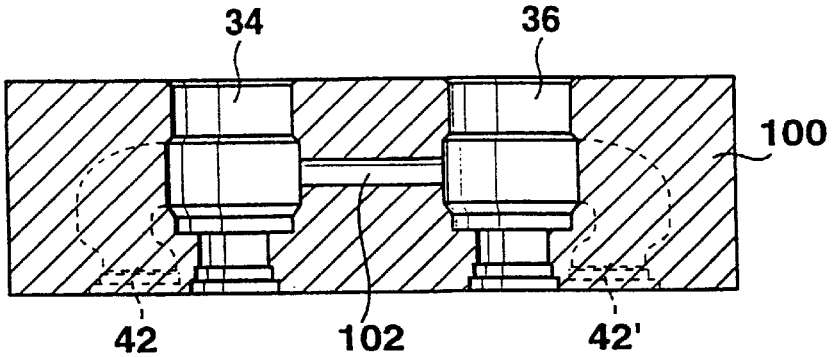

The valve block 100 shown in FIG. 10 shows two parallel connected valve reception cavities 34, 36 which are connected by means of a link conduit 102.

Figure 11:
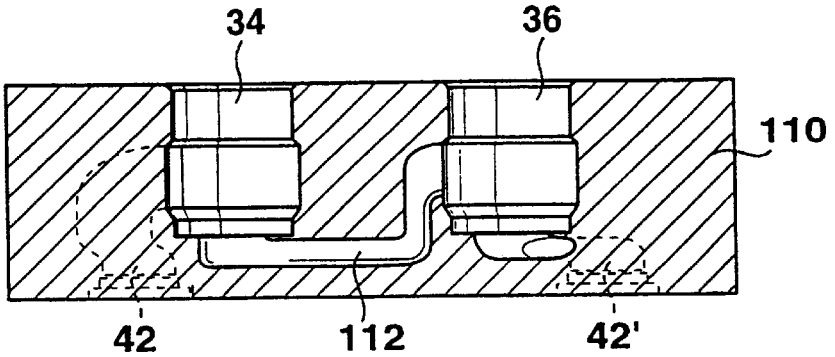
Figure 12:
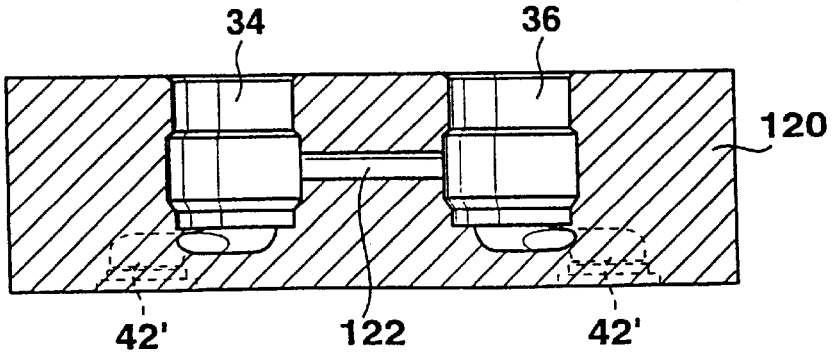

The valve block 110 shown in FIG. 11 corresponds to the valve block 70 shown in FIG. 7, but leads the pump conduit and the tank conduit 42, 42' to the front of the valve and not to the valve space.

All valve blocks 50 through 120 shown in the FIGS. 5 through 12 can be connected to the valve block interface 22, 24 of the middle block. The conduit which is not needed for the moment is hereby sealed in such a way that the hydraulic directional valve as a whole is not hindered in its function and that no hydraulic oil is leaking from the corresponding connection. This sealing is achieved by a plug, a seal or the like.

All valve blocks 50 through 120 are also equipped with control conduits (x, y) 14 as can be seen in the FIGS. 2 and 4. In the other figures, the control conduits are not shown, in order to keep the figure clear.

As already explained above, any hydraulic circuit can be made by combining the middle block 2 with one or two valve blocks 50 through 120 and by using appropriate valve units inserted in the valve reception cavities 34, 36. The hydraulic direction valve can thus be manufactured at low cost in modular technique and it is possible to replace the hydraulic circuit in use by another hydraulic circuit by exchanging single valves and/or single valve blocks at any time.

A hydraulic control block with only two valve units is shown in FIGS. 13 and 14. As can be seen in FIG. 13, this control block consists of one valve block 70 according to FIG. 7 onto which two valve units with one valve 30 and one one-way valve 35 each are arranged. The valve block 70 is fastened onto a connection plate 130 onto which the hydraulic conduits P, T, A, x and y are also connected.

Such a "small" control block with only two valve units can often be used in hydraulic installations. In other embodiments not shown, other valve blocks 50, 60, 70, 80, 90, 100, 110, 120 can be used to create a small control block. The choice of the required valve block only depends on the connecting conditions required by the application, since all valve blocks according to one of the FIGS. 5 through 12 are compatible with the connection plate 130.

In all valve blocks, the pump conduit 42' leads to the second valve reception cavity 36, while the tank conduit 42 is connected with the first valve reception cavity 34. Moreover, in the embodiments shown in the FIGS. 6 through 12, the valve reception cavities 34, 36 are connected directly via connecting and link conduits 52, 54, 62, 72, 84, 92, 102, 112, 122. In the embodiment according to FIG. 5, the valve reception cavities 34, 36 are connected via the work conduit A or B.

In embodiments not shown, complementary conduits are drilled subsequently into the valve block 60, 70, 80, 90, 100, 110, 120, and to connect the corresponding connecting and link conduits 52, 54, 62, 72, 84, 92, 102, 112, 122 or the valve reception cavity 34, 36 with the work conduit A or B.

As can be seen in the figures, the hydraulic conduits in the middle block and in the valve blocks are designed so that, when the flow direction is inverted, the flow passing through the valves is inverted too, so that in blocks already in use a new hydraulic connection for a new application can be created, if needed, by only changing the connection of the valves.

In an embodiment not shown, the central block is not only provided with the control conduits x and y but also with the control conduits $z_1$ and $z_2$. These are used for the hydraulic connection of the valves with external devices.

In another not shown embodiment one or more hydraulic conduits in the middle block and in the valve blocks are designed as blind pockets, i.e. the corresponding hydraulic conduit is not designed as a through conduit but is closed on one side. The pump conduit, the tank conduit, the work conduits and the control conduits are hereby installed throughout the whole block starting from the connecting interface, but end just in front of the corresponding outlet so that a thin wall remains which is still strong enough to resist the working pressure. A middle block is thus created, which can be used for any circuit since a conduit is only opened, more particularly by drilling, when it has been determined which one will be used.

List of Numeral

| | | | |
|---|---|---|---|
| 2 | middle block | 50 | valve block |
| 4 | connecting side | 52 | connecting conduit |
| 6 | left valve side | 54 | connecting conduit |
| 8 | pilot valve side | 60 | valve block |
| 10 | right valve side | 62 | connecting conduit |
| 12 | connection interface | 70 | valve block |
| 13 | pilot valve interface | 72 | connecting conduit |
| 14 | control conduit | 80 | valve block |
| 16 | front section | 82 | connecting conduit |
| 20 | rear section | 84 | connecting conduit |
| 22 | valve block interface | 90 | valve block |
| 24 | valve block interface | 92 | connecting conduit |
| 25 | segments | 100 | valve block |
| 26 | bore scheme | 102 | link conduit |
| 28 | bore scheme | 110 | valve block |
| 30 | valve | 112 | link conduit |
| 31 | electromagnetic proportional contolling unit | | |
| 32 | pilot valve | 120 | valve block control |
| 33 | valve | 122 | link conduit |
| 34 | valve reception cavity | 130 | connection plate |
| 35 | one-way valve | | |
| 36 | valve reception cavity | P | pump conduit |
| 38 | middle block interface | T | tank conduit |
| 40 | valve plane | A | work conduit |
| 42 | pump/tank connecting conduit | B | work conduit |
| 42' | pump/tank connecting conduit | C1–C4 | valve unit |
| 44 | valve space | | |
| 46 | valve space | | |

I claim:

1. A central block for a pilot controlled valve system having a standardized connection interface, a pilot valve interface and a pump conduit, a tank conduit, a first work conduit, a second work conduit, a first control conduit and a second control conduit and, wherein the central block comprises a middle block having a first valve side and a second valve side;

a first valve block detachably securable to the first valve side and having at least two valve reception cavities therein for receiving one valve unit each;

a first valve block interface positioned between the first valve block and the middle block;

a second valve block detachably securable to the second valve side and having at least two valve reception cavities therein for receiving one valve unit each; and a second valve block interface positioned between the second valve block and the middle block.

2. A central block according to claim 1, wherein the valve units may control flow through the hydraulic conduits in any flow direction.

3. A central block according to claim 1, wherein the pump conduit and the tank conduit are located in a rear section of the middle block and the first and second work conduits are located in a front section of the middle block.

4. A central block according to claim 3, wherein at least one of the pump conduit, the tank conduit and the work conduits are exclusively running partly perpendicular and partly parallel to the standardized connection interface.

5. A central block according to claim 3, wherein each of the pump conduit, the tank conduit and the work conduits are exclusively running partly perpendicular and partly parallel to the standardized connection interface.

6. A central block according to claim 1, wherein the standardized connection interface is located on a connecting side of the middle block and the standardized connection interface is hydraulically connected by the pump conduit and the tank conduit with each valve side and that the standardized connection interface is hydraulically connected by the first work conduit with a first valve side and by the second work conduit with the second valve side.

7. A central block according to claim 1, wherein the first and second valve block interfaces have identical bore schemes.

8. A central block according to claim 1, wherein the first and second valve block interfaces have point symmetrical bore schemes.

9. A central block according to claim 1, wherein at least one of the first control conduit and the second control conduit are blind pockets.

10. A central block according to claim 1 further comprising a pilot valve mountable into the pilot valve interface for driving each valve unit.

11. A central block according to claim 1, wherein at least one of the valve blocks further comprises exactly one tank connecting conduit and one pump connecting conduit, and the tank connecting conduit leads to the first valve reception cavity and the pump connecting conduit leads to the second valve reception cavity.

12. A central block according to claim 11, wherein the valve units may control flow through the hydraulic conduits in any flow direction.

13. A central block according to claim 11, wherein the valve reception cavities of at least one of the valve blocks are connected to each other via connecting and link conduits.

14. A central block according to claim 11, having a bore scheme in which all connections are aligned.

15. A valve block according to claim 11, wherein at least one of the first control conduit and the second control conduit are blind pockets.

* * * * *